US008820661B2

(12) United States Patent
Clarke

(10) Patent No.: US 8,820,661 B2
(45) Date of Patent: Sep. 2, 2014

(54) HOSE END SPRAYER WITH MULTI-SIZE BOTTLE CONNECTORS AND BOTTLE ADAPTER

(75) Inventor: Michael T. Clarke, Grand Rapids, MI (US)

(73) Assignee: Root-Lowell Manufacturing Company, Lowell, MI (US)

( * ) Notice: Subject to any disclaimer, the term of this patent is extended or adjusted under 35 U.S.C. 154(b) by 885 days.

(21) Appl. No.: 13/017,284

(22) Filed: Jan. 31, 2011

(65) Prior Publication Data

US 2011/0121102 A1 May 26, 2011

Related U.S. Application Data

(63) Continuation-in-part of application No. 12/044,274, filed on Mar. 7, 2008, now abandoned.

(51) Int. Cl.

| | |
|---|---|
| ***B05B 7/26*** | (2006.01) |
| ***B05B 7/28*** | (2006.01) |
| ***B05B 7/30*** | (2006.01) |
| ***B05B 1/00*** | (2006.01) |
| ***B05B 7/24*** | (2006.01) |
| ***B05B 7/04*** | (2006.01) |

(52) U.S. Cl.

CPC ..... *B05B 7/2408* (2013.01); *B05B 7/04* (2013.01); *B05B 7/2443* (2013.01)

USPC ..... 239/397

(58) Field of Classification Search

CPC ..... B05B 7/04; B05B 7/0408; B05B 7/24; B05B 7/2408; B05B 7/244

USPC ..... 239/289, 310, 315, 316, 318, 337, 339, 239/366, 397, 429, 434, 600; 215/319, 386; 141/367, 368

See application file for complete search history.

(56) References Cited

U.S. PATENT DOCUMENTS

| | | | | |
|---|---|---|---|---|
| 3,112,884 | A | 12/1963 | Gilmour | |
| 3,191,869 | A | 6/1965 | Gilmour | |
| 4,475,689 | A * | 10/1984 | Hauger et al. | 239/318 |
| 4,583,668 | A | 4/1986 | Maynard, Jr. | |
| 4,595,217 | A | 6/1986 | Siegel | |
| 5,647,732 | A | 7/1997 | Cali et al. | |
| 6,338,417 | B1 * | 1/2002 | Ferraro | 220/23.83 |
| 6,415,937 | B1 * | 7/2002 | DeJong et al. | 215/386 |
| 6,425,534 | B2 | 7/2002 | Ketcham et al. | |
| 6,666,345 | B2 * | 12/2003 | Blanding | 215/11.1 |
| 6,672,520 | B2 | 1/2004 | Shanklin et al. | |

* cited by examiner

*Primary Examiner* — Ryan Reis

(74) *Attorney, Agent, or Firm* — Waters & Oppenhuizen PLC; John A. Waters

(57) ABSTRACT

A hose end sprayer has a sprayer lid and a container. The sprayer lid has a cap with a pair of bottle connectors formed of single-ended, fixed diameter, threaded sleeves of different radii mounted on the underside of the sprayer lid's cap. The connectors and a threaded adapter allow the sprayer lid to be connected with containers having mouths of different sizes, including containers in which liquid chemicals are sold. A liquid conduit extends across the cap between a hose inlet on one end and a spray nozzle on the other end, with a siphon tube intersecting the conduit within the periphery of the smaller of the bottle connectors, with mixture of pressurized carrier water entering the liquid conduit at the hose inlet with liquid chemical siphoned from the container through the siphon tube. The chemical/water admixture is expelled from the spray nozzle.

7 Claims, 2 Drawing Sheets

HOSE END SPRAYER WITH MULTI-SIZE BOTTLE CONNECTORS AND BOTTLE ADAPTER

CROSS REFERENCE TO RELATED APPLICATIONS

This application is a continuation-in-part of application Ser. No. 12/044,274, filed Mar. 7, 2008, which is incorporated by reference herein, in its entirety, for all purposes.

FIELD OF THE INVENTION

The present invention relates to hose end sprayers, and more particularly, a hose end sprayer having multiple bottle connectors mounted on the underside of the sprayer cap and an adapter for attachment to different sized bottles.

BACKGROUND INFORMATION

A typical hose end sprayer for home and garden use comprises a liquid chemical dispenser that mounts on the end of a hose for dispensing a mixture of a liquid chemical and water from the hose. Typically, a hose end sprayer is employed with a generic or all purpose liquid container that is sold as a part of the product. The hose end sprayer comprises the liquid container and a sprayer lid comprising a cap that screws on the container, with a liquid conduit extending across the cap between a hose inlet and a nozzle outlet. A siphon tube extends downwardly from the conduit for drawing liquid chemical from the container into the stream of water that flows through the conduit from the hose inlet to the nozzle outlet.

To use a hose end sprayer, liquid chemical from a concentrate container is usually poured into the generic liquid container and sometimes mixed with water in the container to control the water/liquid chemical mixing rates. When the spraying is done, the remaining portion of liquid in the container is often either discarded or poured back into the supply bottle for the liquid concentrate. This promotes contamination and spills. Sometimes the remaining portion of the liquid is stored in the container, creating a question regarding the identity of the mixture at a later date because the container is not labeled with the manufacturer's product.

An object of the present invention is to provide an improved hose end sprayer to which, in addition to the generic bottle, concentrate bottles of different sizes can be directly attached, eliminating contamination, spills, and labeling problems common with current hose end sprayers.

SUMMARY OF THE INVENTION

The present invention is embodied as a hose end sprayer that has a sprayer lid having multiple bottle connectors of different sizes for connecting the sprayer lid to liquid chemical bottles of different sizes. The sprayer lid has a cap with a top and two or more annular bottle connectors extending downwardly from the top. The lid also has a liquid conduit that extends across the lid from a hose inlet on one end to a nozzle outlet at an opposite end. A siphon tube extends downwardly from the liquid conduit from a position inside the periphery of the smallest connector to a lower end that is positioned to have fluid communication with liquid in a container attached to the sprayer lid. The siphon tube draws liquid from the container into a stream of water that flows through the liquid conduit from the hose inlet to the nozzle outlet. The multiple bottle connectors are embodied as single-ended, fixed diameter, threaded sleeves of differing radii mounted on the underside of the cap of the sprayer lid. The bottle connectors are sized to be attachable to the mouths of containers of different sizes, including containers in which liquid chemicals are sold, as well as a generic container typically provided with a hose end sprayer.

The present invention is alternatively embodied as a hose end sprayer that has a sprayer lid with two bottle connectors of different sizes for connecting the sprayer lid to liquid chemical bottles of different sizes. The sprayer lid has a cap with a top and two annular bottle connectors extending downwardly from the top. The lid also has a liquid conduit that extends across the lid from a hose inlet on one end to a nozzle outlet at an opposite end. A siphon tube extends downwardly from the liquid conduit from a position inside the periphery of the smaller connector to a lower end that is positioned to have fluid communication with liquid in a container attached to the sprayer lid. The siphon tube draws liquid from the container into a stream of water that flows through the liquid conduit from the hose inlet to the nozzle outlet. The bottle connectors are embodied as two single-ended, fixed diameter, threaded sleeves of differing radii mounted on the underside of the cap of the sprayer lid. The bottle connectors are sized so that one is attachable to the mouths of a first size of containers in which liquid chemicals are sold, and the other is sized to be attachable to the mouth of a generic container typically provided with a hose end sprayer. This embodiment also has at least one thread adapter, such that each thread adapter is threaded at one end to be attachable to one of the bottle connectors, and threaded at the other end to be attachable to the mouths of a second size of containers in which liquid chemicals are sold.

Because a hose end sprayer lid according these embodiments has cap with multiple size bottle connectors and/or thread adapters, the lid can fit on the generic bottle that is sold with the sprayer, or it can connect on different size bottles in which the liquid concentrates are purchased. Thus, a liquid concentrate such as fertilizer or weed killer can be purchased from the store and screwed right into the hose end sprayer without first having to pour the liquid concentrate into the generic container. By doing this, when the spraying is complete, the liquid concentrate bottle can be unscrewed from the sprayer lid, and the sealing cap for the concentrate bottle can be screwed on for storage. Because the supply bottle is labeled with the manufacturer's product, there is never any problem or question about the identity of the contents of the sprayer bottle when spraying is through, and there is no need to pour the liquid back into the supply bottle, a task that promotes contamination and spills.

An adjustable mixing ratio valve is desirably incorporated in the lid for adjusting the mixing ratio of the liquid chemical and water. The sprayer is desirably actuated by a manual trigger valve incorporated in the sprayer lid.

DETAILED DESCRIPTION

Figure 1:
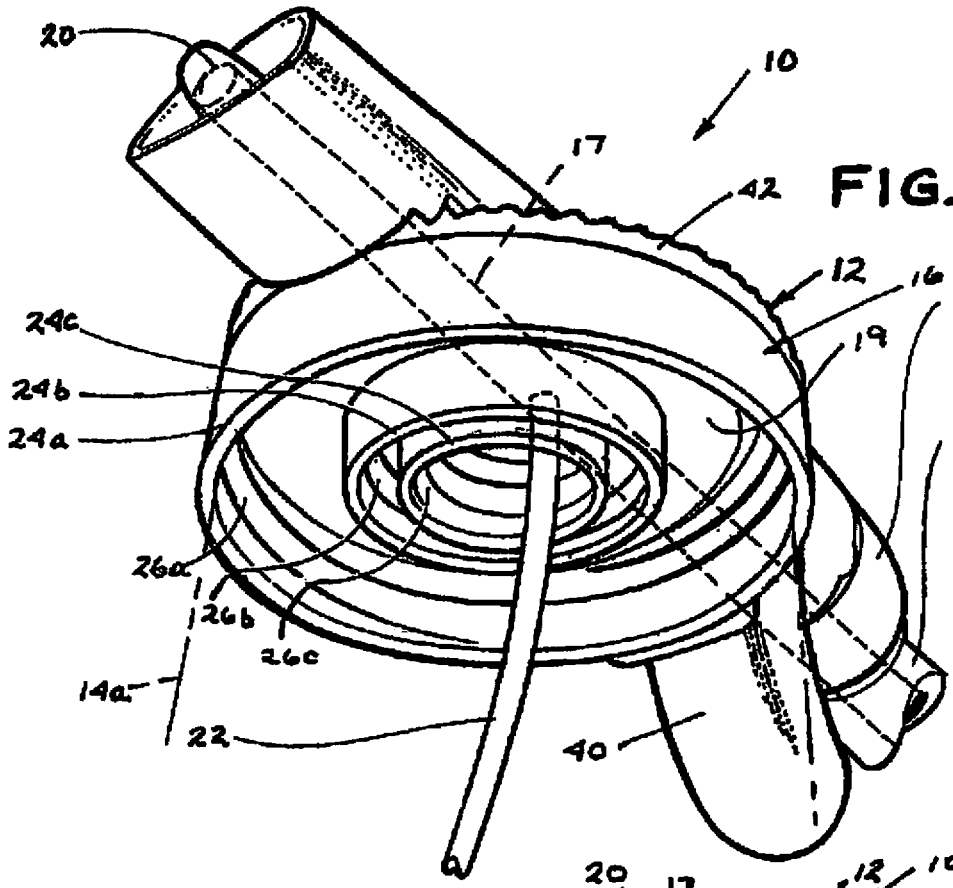
FIG. 1 is a perspective view of an embodiment of the hose end sprayer showing the sprayer lid and connectors for containers of different sizes.

Referring to FIG. 1, a hose end sprayer 10 with multi-size bottle connectors is shown attached to an external garden hose 11. The present invention may also be embodied to employ other types of hoses.

The sprayer 10 has a lid 12 and a container 14. The lid 12 has a cap 16, a transverse liquid conduit 17, and a siphon tube 22. The transverse liquid conduit extends across the upper side of the cap 16 and has a hose inlet 18 and an outlet nozzle 20 at opposite ends. Multiple, single-ended, fixed diameter, threaded sleeve bottle connectors 24*a*, 24*b*, 24*c* of differing radii are mounted on the underside of the cap 16 such that each bottle connector 24*a-c* is contained within the area defined by any of the bottle connectors 24*a-c* having a larger radius. The inner surface of each of the bottle connectors 24*a-c* has corresponding threads 26*a*, 26*b*, 26*c* to which the mouths 28*a*, 28*b*, 28*c* of respective containers 14*a*, 14*b*, 14*c*, and other containers with threaded mouths, can attach. The sprayer 10 according to this embodiment is disclosed as having three bottle connectors 24*a-c*, but the sprayer 10 may be alternatively embodied to include more or fewer bottle connectors. The connectors desirably are unitarily formed as integral flanges on the underside of the cap 16, with the cap being molded from a synthetic resin and being substantially rigid. Alternatively, the connectors are formed as separate caps, each having a top and a threaded peripheral flange, with the caps being stacked and fastened together to form a composite cap with multiple connectors.

The liquid conduit 17 desirably extends across the upper side of cap 16 so as not to interfere with connector threads 26. The hose inlet 18 connects to an external hose 11 such as a conventional garden hose using a threaded connector 36 or other hose connector that is connectable to the outlet of the hose.

Figure 2A:
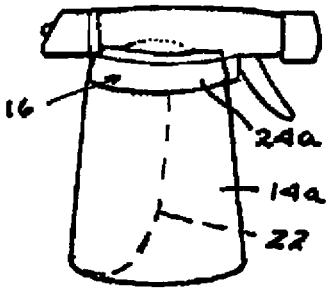
FIGS. 2A-2C are elevation views showing the sprayer lid attached to a generic container and two liquid chemical containers having outlets of different sizes.
Figure 2B:
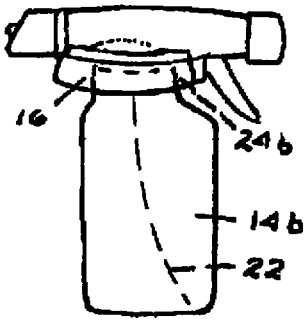
Figure 2C:
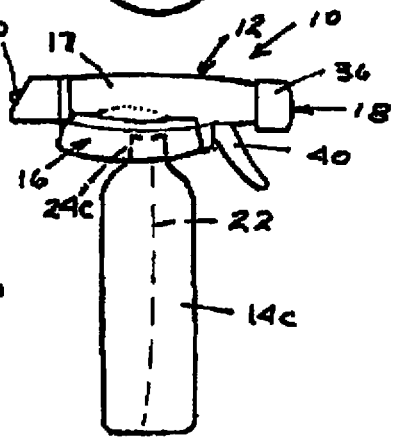

A siphon tube 22 joins the liquid conduit 17 within the area defined by the smallest bottle connector 24*c*, and thus is in position to communicate with all bottles that can be connected with the lid. The siphon tube 22 extends downwardly such that it extends to a lower end that is positioned adjacent the bottom of the container 14 when the container 14 is attached to the lid 12. Desirably, siphon tube 22 is long enough to extend to the bottom of the tallest container used, but is flexible so that it can be used with shorter containers (see FIGS. 2A-2C). The siphon tube 22 draws liquid chemical 38 from the container 14 into water traveling through the liquid conduit 17 from the hose 11 so that a mixture of water and liquid chemical is expelled from the nozzle 20.

The sprayer 10 is optionally embodied so as to include a dial operated conventional flow control valve 24 to control the mixing ratio of liquid chemical to water in the mixed liquid sprayed from the nozzle. The sprayer 10 is preferably embodied to have a manually operated trigger valve 40 for convenient starting and stopping of water flow through the sprayer 10.

Figure 3:
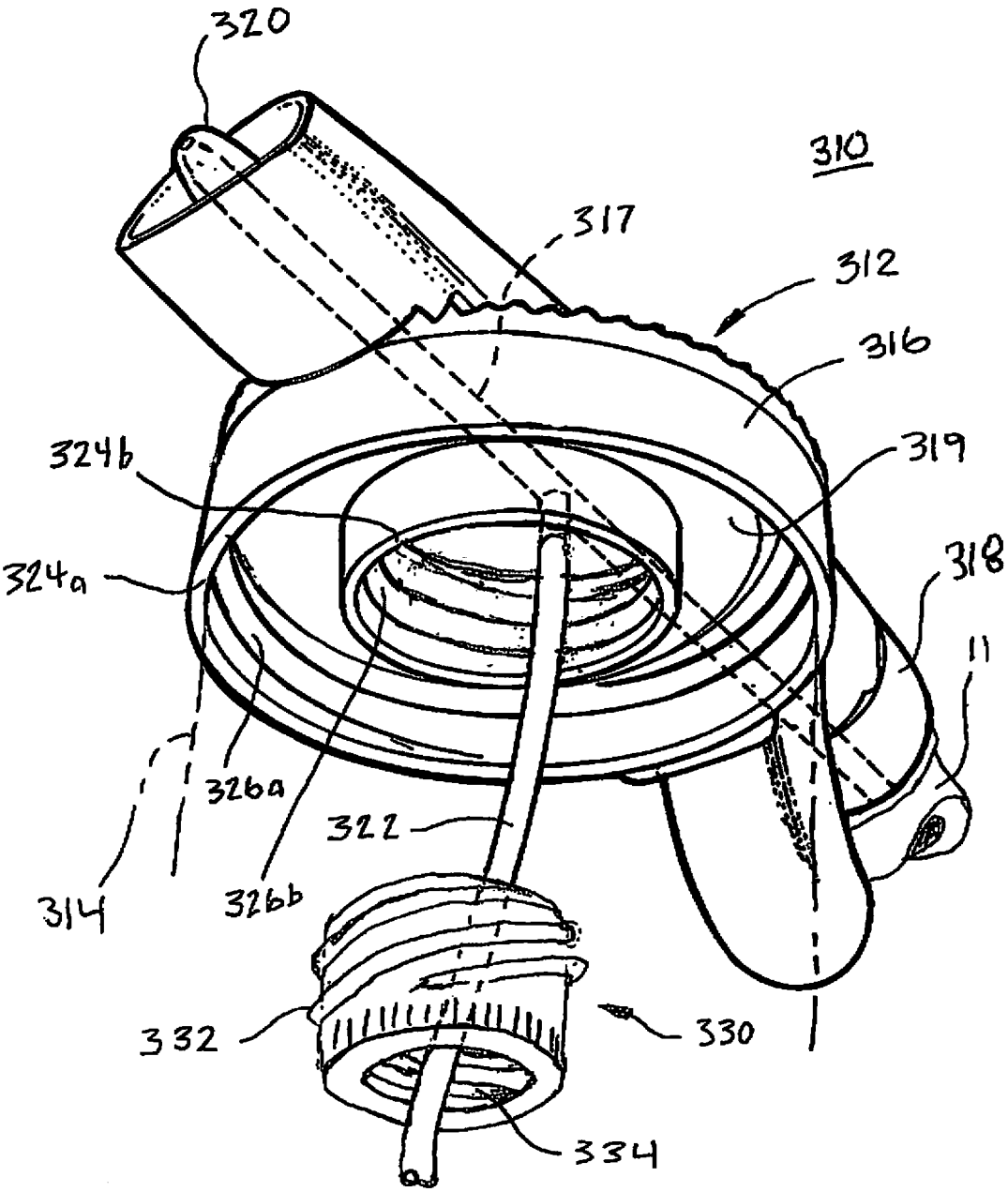
FIG. 3 is a perspective view of another embodiment of the hose end sprayer showing the sprayer lid and connectors and a thread adapter for containers of different sizes.

Referring to FIG. 3, a hose end sprayer 310 with dual-size bottle connectors is shown in perspective view attached to an external garden hose 11. The sprayer 310 has a lid 312 and a container 314. The lid 312 has a cap 316, a transverse liquid conduit 317, and a siphon tube 322. The transverse liquid conduit extends across the upper side of the cap 316 and has a hose inlet 318 and an outlet nozzle 320 at opposite ends. A pair of single-ended, fixed diameter, threaded sleeve bottle connectors 324*a*, 324*b* of differing radii are mounted on the underside 319 of the cap 316 such that the smaller bottle connector is contained within the area defined by the bottle connector having a larger radius.

The inner surface of each of the bottle connectors 324*a*, 324*b* has corresponding threads 326*a*, 326*b* to which the mouths of appropriately sized containers with threaded mouths can attach. The sprayer 310 according to this embodiment is disclosed as having two bottle connectors 324*a*, 324*b*, but the sprayer 310 may be alternatively embodied to include more or fewer bottle connectors. The connectors desirably are unitarily formed as integral flanges on the underside 319 of the cap 316, with the cap being molded from a synthetic resin and being substantially rigid.

The hose end sprayer 310 of this embodiment has one or more thread adapters 330. The thread adapter 330 has threads 332 at one end sized for attachment to the smaller bottle connector 324*b*, and threads 334 at the other end to sized for attachment to the mouth of a container of a different size in which liquid chemicals are sold. In this embodiment the thread adapter 330 provides a step down adaptation so that the inner connector 324*b* can provide connection to a container having a smaller mouth than would fit directly onto the integral connector 324*b*. The thread adapter is alternatively embodied to provide a step up adaptation so that containers having larger mouths (or the same diameter but differing thread specifications) can fasten to the smaller connector 324*b*. Thread adapters to practice the present invention may also be alternatively embodied to provide for connection of diverse bottle mouth sizes to the outer, larger connector 324*a*.

As with the embodiment of FIG. 1, the hose inlet 318 connects to the external hose 11 such as a conventional garden hose using a threaded connector 336 or other hose connector that is connectable to the outlet of the hose.

Analogous to the embodiment of FIG. 1, the siphon tube 322 joins the liquid conduit 317 within the area defined by the smaller bottle connector 324*b*, and thus is in position to communicate with all bottles that can be connected with the lid and function as described above.

The present invention is alternatively embodied as a kit that includes a sprayer cap with two threaded connectors, at least one fluid container, one or more thread adapters, and two or more siphon tubes. The kit is optionally augmented with additional thread adapters and/or additional siphon tubes.

Embodiments of a hose end sprayer have been described. It will be understood by those skilled in the art that the present invention may be embodied in other specific forms without departing from the scope of the invention disclosed and that the examples and embodiments described herein are in all respects illustrative and not restrictive. Those skilled in the art of the present invention will recognize that other embodiments using the concepts described herein are also possible. Further, any reference to claim elements in the singular, for example, using the articles "a," "an," or "the" is not to be construed as limiting the element to the singular.

What is claimed is:

1. A hose end sprayer with multi-size bottle connectors comprising:

a lid including:

a cap having a top and two annular bottle connectors with different diameters positioned on an underside of the top;

a liquid conduit extending across the top, the conduit having an inlet at one end that is attachable to a hose and an outlet nozzle at an opposite end for discharging liquid; and a siphon tube having an upper end connected to and in fluid communication with an interior of the conduit at a point inside of the periphery of the smaller bottle connector, the siphon tube extending downwardly from the upper end to a lower end positioned below the upper end, the siphon tube being formed such that liquid in communication with the lower end of the siphon tube is urged upwardly from the lower end through the upper end into the liquid conduit as a result of liquid flowing through the liquid conduit causing the admixture of liquid in the inlet conduit with liquid drawn through the siphon tube, with the admixed liquids being discharged from the outlet nozzle;

at least one adapter threaded at a first end to be attachable to one of the annular bottle connectors and threaded at a second end, opposed to the first end, having a diameter that is different from both of the two annular bottle connectors; and at least one liquid container adapted to hold a liquid chemical, the liquid container having an open mouth of a size and shape that mates with and is releasably attachable to one of the annular bottle connectors or the adapter, such that when the container is attached to the lid, or when the container is attached to the adapter and the adapter is attached to the lid, and the container is filled with a sufficient quantity of liquid chemical that the liquid chemical is in communication with the lower end of the siphon tube, the liquid chemical is siphoned into liquid that is transmitted through the sprayer from the hose inlet to the nozzle, thereby causing admixed liquids to be discharged from the nozzle.

2. The hose end sprayer according to claim 1, wherein the cap further comprises a mixing valve controlled by a movable dial incorporated in the cap that regulates the proportions of liquid chemical from the container and liquid from the hose that are discharged from the sprayer.

3. The hose end sprayer according to claim 1, wherein the cap has a single top and the connectors are formed together unitarily with the top from synthetic resin.

4. A sprayer kit, the kit comprising:

a hose end sprayer lid with dual-size bottle connectors, wherein the sprayer lid comprises:

a cap having a top and two annular bottle connectors with different diameters positioned on an underside of the top; and a liquid conduit extending across the top, the conduit having an inlet at one end that is attachable to a hose and an outlet nozzle at an opposite end for discharging liquid;

at least one adapter, wherein each adapter is threaded at a first end to be attachable to one of the annular bottle connectors and threaded at a second end, opposed to the first end, having a diameter that is different from both of the two annular bottle connectors;

two or more siphon tubes of differing lengths, wherein each of the siphon tubes has an upper end connectable to be in fluid communication with an interior of the conduit at a point inside of the periphery of the smaller bottle connector, each siphon tube extending downwardly from the upper end to a lower end positioned below the upper end, each siphon tube being formed such that liquid in communication with the lower end of the siphon tube is urged upwardly from the lower end through the upper end into the liquid conduit when connected to be in fluid communication with the conduit as a result of liquid flowing through the inlet into the liquid conduit; and one or more liquid containers adapted to hold a liquid chemical, each liquid container having an open mouth of a size and shape that mates with and is releasably attachable to one of the annular bottle connectors or the adapter, such that when the container is attached to the lid or when the container is attached to the adapter and the adapter is attached to the lid, and when one of the siphon tubes is connected to be in fluid communication with the conduit, and the container is filled with a sufficient quantity of liquid chemical that the liquid chemical is in communication with the lower end of the siphon tube, the liquid chemical is siphoned into liquid flowing through the sprayer from the inlet of the conduit to the nozzle, causing admixed liquids to be discharged from the nozzle.

5. The sprayer kit of claim 4, wherein at least one of the liquid containers comprises a retail packaging container in which a chemical is customarily distributed, and wherein one of the siphon tubes has a first length such that a lower end of that siphon tube is positioned so as to be in fluid communication with the interior of the retail packaging container at a point adjacent the bottom thereof when the retail packaging container is attached directly to one of the bottle connectors.

6. The sprayer kit of claim 4, wherein at least one of the liquid containers comprises a retail packaging container in which a chemical is customarily distributed, and wherein one of the siphon tubes has a first length such that a lower end of that siphon tube is positioned so as to be in fluid communication with the interior of the retail packaging container at a point adjacent the bottom thereof when the retail packaging container is attached to one of the bottle connectors using the adapter.

7. The sprayer kit of claim 4, wherein at least one of the liquid containers comprises a liquid chemical bottle of a type that is customarily used to package and sell the liquid chemical, and none of the bottle connectors is designed to fit on a mouth on the liquid chemical bottle, such that the lid is attachable, using the adapter, to the liquid chemical bottle without transfer of the liquid chemical to another container for use with the hose end sprayer.

* * * * *